US005607062A

United States Patent [19]

Poser et al.

[11] Patent Number: 5,607,062

[45] Date of Patent: Mar. 4, 1997

[54] SCREEN MODULE FOR PREPARING COSMETICS NESTED SCREENS OF DIFFERENT MESH SIZES

[75] Inventors: Kimberly J. Poser; Benjamin K. Murugesu, both of Kitchener, Canada

[73] Assignee: Quadro Engineering Inc., Waterloo, Canada

[21] Appl. No.: 516,661

[22] Filed: Aug. 18, 1995

[51] Int. Cl.[6] ..... B07B 1/06

[52] U.S. Cl. ..... 209/283; 209/291; 209/306; 241/69; 241/74; 241/89.2

[58] Field of Search ..... 209/273, 283, 209/291, 306, 403; 241/69, 74, 89.2

[56] References Cited

U.S. PATENT DOCUMENTS

| | | | |
|---|---|---|---|
| 2,695,133 | 11/1954 | Drury | 209/291 X |
| 4,759,507 | 7/1988 | Lynch et al. . | |
| 4,768,722 | 9/1988 | Lynch et al. . | |
| 4,773,599 | 9/1988 | Lynch et al. . | |
| 5,242,058 | 9/1993 | Jones | 209/403 |
| 5,282,579 | 2/1994 | Poser et al. . | |
| 5,330,113 | 7/1994 | Poser et al. . | |
| 5,405,094 | 4/1995 | Poser et al. . | |

*Primary Examiner*—D. Glenn Dayoan

*Attorney, Agent, or Firm*—Arne I. Fors; Jeffrey T. Imai; D. Doak Horne

[57] ABSTRACT

A screen module for a size reduction machine has a rigid screen having a tapered apertured wall formed in a frusto-conical shape. The rigid screen has an open wide end and a flat end. The wide end is mountable within a channel of the size reduction machine at a predetermined distance from a complementarily shaped impeller. The module has a fine screen nested within the rigid screen and against the tapered apertured wall. The fine screen has a wide end and a narrow end corresponding to the apertured wall. An adaptor disc is releasably secured within the rigid screen at the flat end. The adaptor has a tapered outer perimeter for seating against the tapered apertured wall when the adaptor disc is secured within the rigid screen, clamping the narrow end of the fine screen therebetween. A clamp ring is releasably secured at the open wide end of the rigid screen. The clamp ring has a tapered inner perimeter for seating against the tapered apertured wall when secured against the open wide end, clamping the wide end of the fine screen therebetween.

6 Claims, 4 Drawing Sheets

SCREEN MODULE FOR PREPARING COSMETICS NESTED SCREENS OF DIFFERENT MESH SIZES

FIELD OF THE INVENTION

This invention relates to a screen module for preparing cosmetics using a size reduction machine. In particular, this invention relates to a screen module having a fine screen nested and secured against a rigid support screen.

BACKGROUND OF THE INVENTION

Size reduction machines utilise a frusto-conical shaped screen located in a channel between an input and an output. Such size reduction machines are more particularly described in U.S. Pat. Nos. 4,759,507 and 5,330,113. In these machines, various screens and impellers are used depending on the size and type of product that is being processed. The screens have apertures in different sizes and shapes to produce a desired milled product.

The production of cosmetics presents particular problems. The particulate size of cosmetics is required to be very fine. As a result fine screens with fine mesh sizes are needed. These screens are delicate and are often damaged during use and during cleaning, requiring frequent replacement.

A secondary screen has been used as support for the primary fine screen in addressing the problem of breakage during use. However, the primary screen is still able to be separated from the secondary screen. Since cosmetics production requires frequent cleaning, the fine screens are routinely damaged once the fine screen has become separated from the secondary screen during cleaning.

SUMMARY OF THE INVENTION

The disadvantages of the prior art may be overcome by providing screen module for a size reduction machine where the module has a fine screen nested with and secured against a support screen for producing fines for cosmetics production.

It is desirable to provide a screen module which can be cleaned and sanitized as a unit minimizing a risk of damage to a fine screen nested within a rigid support screen.

It is still further desirable to provide screen module which can be used in a underdriven size reduction machine.

It is still further desirable to provide screen module which can be used in a top driven size reduction machine.

According to one aspect of the invention, there is provided a screen module for use in a size reduction machine. The module has a rigid screen having a tapered apertured wall formed in a frusto-conical shape. The rigid screen has an open wide end and a flat end. The wide end is mountable within a channel of the size reduction machine at a predetermined distance from a complementarily shaped impeller. The module has a fine screen nested within the rigid screen and against the tapered apertured wall. The fine screen has a wide end and a narrow end corresponding to the apertured wall. An adaptor disc is releasably secured within the rigid screen at the flat end. The adaptor has a tapered outer perimeter for seating against the tapered apertured wall when the adaptor disc is secured within the rigid screen, clamping the narrow end of the fine screen therebetween. A clamp ring is releasably secured at the open wide end of the rigid screen. The clamp ring has a tapered inner perimeter for seating against the tapered apertured wall when secured against the open wide end, clamping the wide end of the fine screen therebetween.

According to another aspect of the invention, there is provided a screen module having an axial bore for receiving a spindle of an underdriven size reduction machine.

According to another aspect of the invention, there is provided a screen module having a closed bottom, and a spindle is drivingly rotated from above the screen module.

DETAILED DESCRIPTION OF THE DRAWINGS

In figures which illustrate embodiments of the invention,

DETAILED DESCRIPTION OF THE INVENTION

Figure 1:
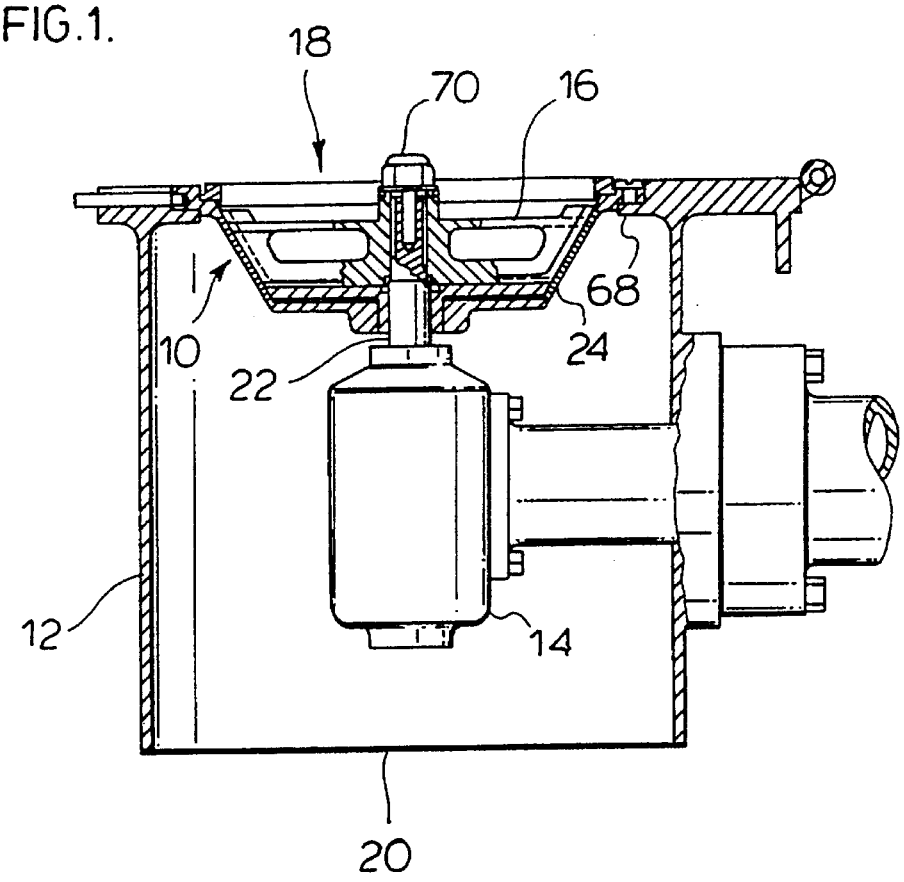
FIG. 1 is a side sectional view of a size reduction machine incorporating a screen module of the present invention.

The size reduction machine incorporating the screen module 10 of the present invention is illustrated in FIG. 1. The size reduction machine generally has a shroud 12, an underdriven gear box 14 and an impeller 16.

Figure 2:
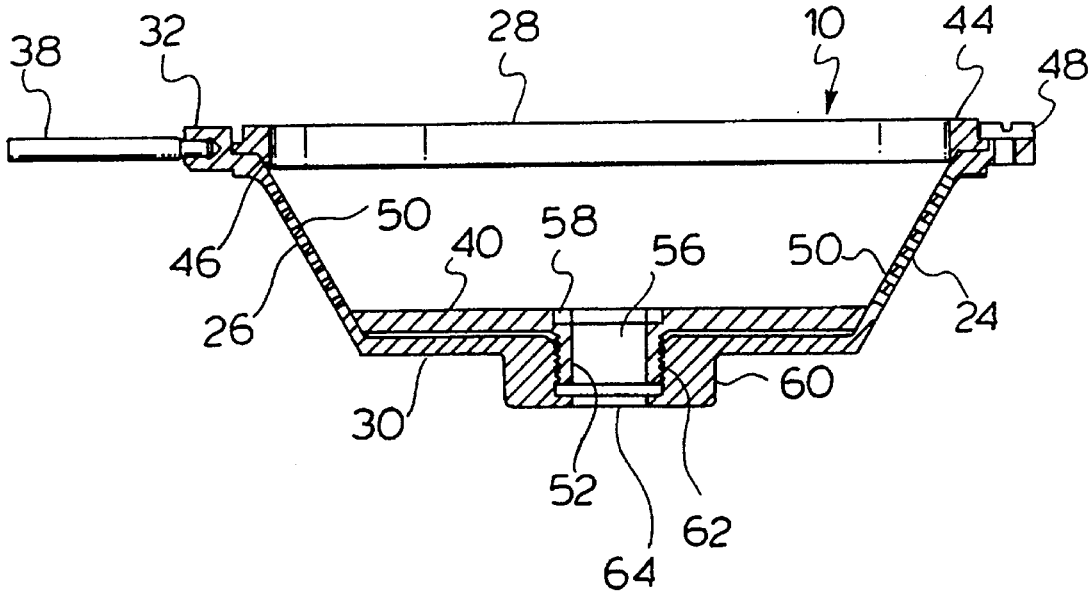
FIG. 2 is a side sectional view of the screen module of the present invention.

Referring to FIGS. 1 and 2, the underdriven gear box 14 and impeller 16 are axially located within the shroud 12 having an input 18 and an output 20. Impeller 16 is mounted on spindle 22 in a manner well known in the art. U.S. Pat. No. 5,330,113 describes an underdriven size reduction machine and a method of mounting the impeller on a spindle and drivingly rotating same. The contents of U.S. Pat. No. 5,330,113 are incorporated herein by reference.

Screen module 10 comprises a rigid screen 24 which has a tapered apertured wall 26 formed in a frusto-conical shape with a wide end 28 and a flat narrow end 30. End 28 is open while end 30 is fully or substantially closed. The rigid screen 24 has a circular flange 32 which surrounds and extends outwardly of the wide end 28. Flange 32 has a recessed lip 34 extending about an inner periphery of the end 28. Spaced about the outer periphery are threaded bores 36 which receive lifting rods 38 which releasably retain screen module 10 onto shroud 12.

Screen module 10 further includes a disc adaptor 40 which is sized to fit within the base of flat end 30. The disc adaptor 40 has a tapered outer periphery 42 which is complementarily shaped to seat against the tapered apertured wall 26 when the adaptor disc 40 is secured within the rigid screen 24.

Screen module 10 also includes a clamp ring 44 which is sized to fit within lip 34. Clamp ring 44 has a tapered inner periphery 46 which is complementarily shaped to seat against the open end 28 of tapered apertured wall 26 when the clamp ring is secured to the rigid screen 24.

Spaced about flange 32 are a plurality of threaded apertures 47 for receiving holding screws 48 which releasably retain clamp ring 44 onto rigid screen 24.

Screen module 10 finally includes a fine screen 50. The fine screen 50 has an open wide end and an open narrow end. The open wide end has a flange 51 extending thereabout. Fine screen 50 is sized and complementarily shaped to nest within the rigid screen 24 to seat against the tapered apertured wall 26. The openings of fine screen 50 will normally be in the range of 0.005" or 100 U.S. standard mesh size, which is greater than the openings of tapered apertured wall 26. Fine screen 50 will generally have a thickness of 0.005" or less. Fine screen 50 is preferably stainless steel.

Adaptor disc 40 has an axially extending tubular section 52 having an external thread 54 and an axial bore 56. Axial bore has a counterbore 58 for receiving a fastening tool used to rotate and lock the adaptor disc 40 to the rigid screen 24. Rigid screen 24 has an external boss 60 which has an axial counterbore 62 having an internal thread and an opening 64. The internal thread is complementary with the external thread 54. The diameter of the axial bore 56 and opening 64 are substantially equal and sized to receive in a sliding fit spindle 22 of gear box 14.

Figure 3:
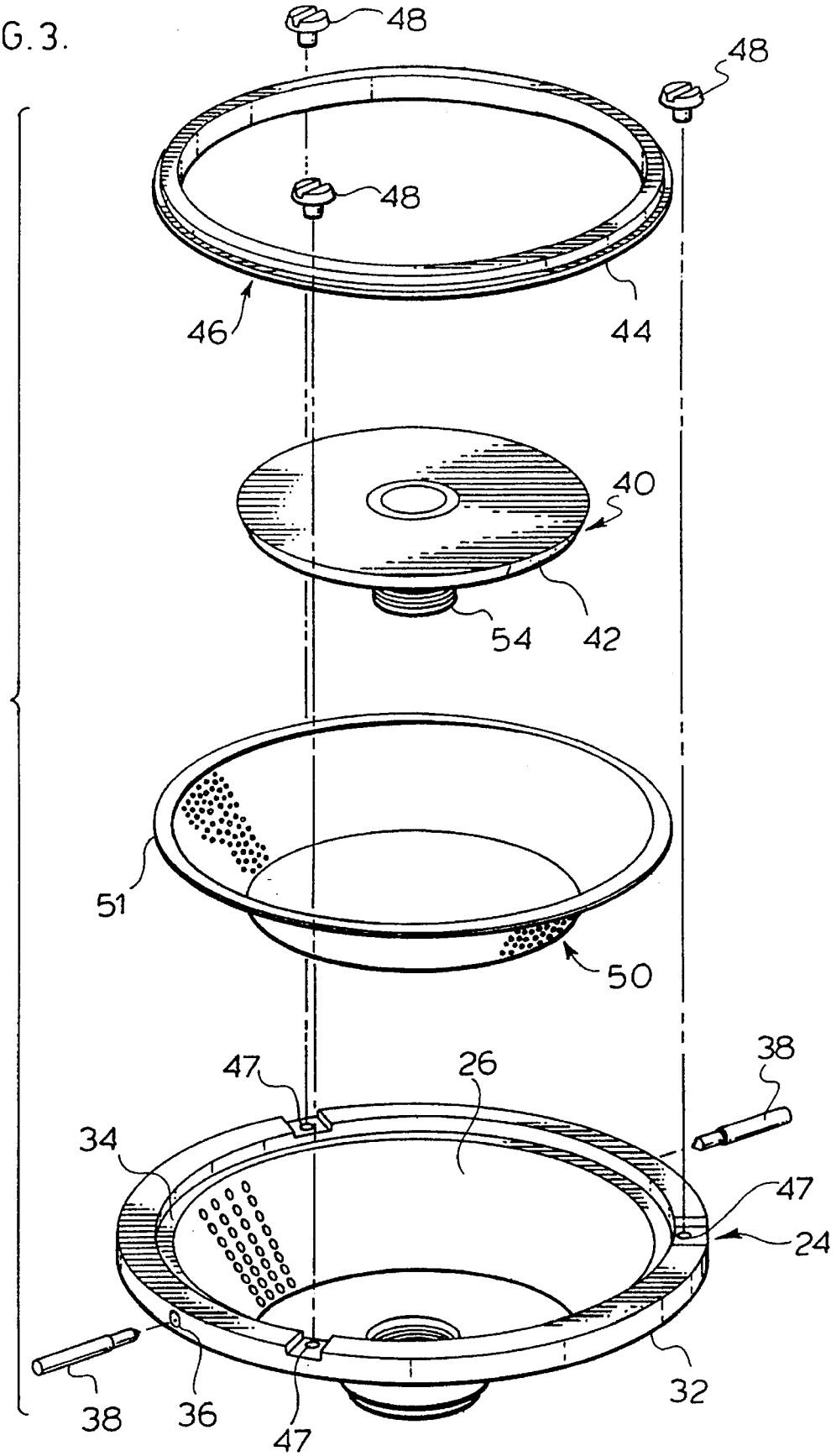
FIG. 3 is an exploded perspective view of the screen module of FIG. 2.
Figure 4:
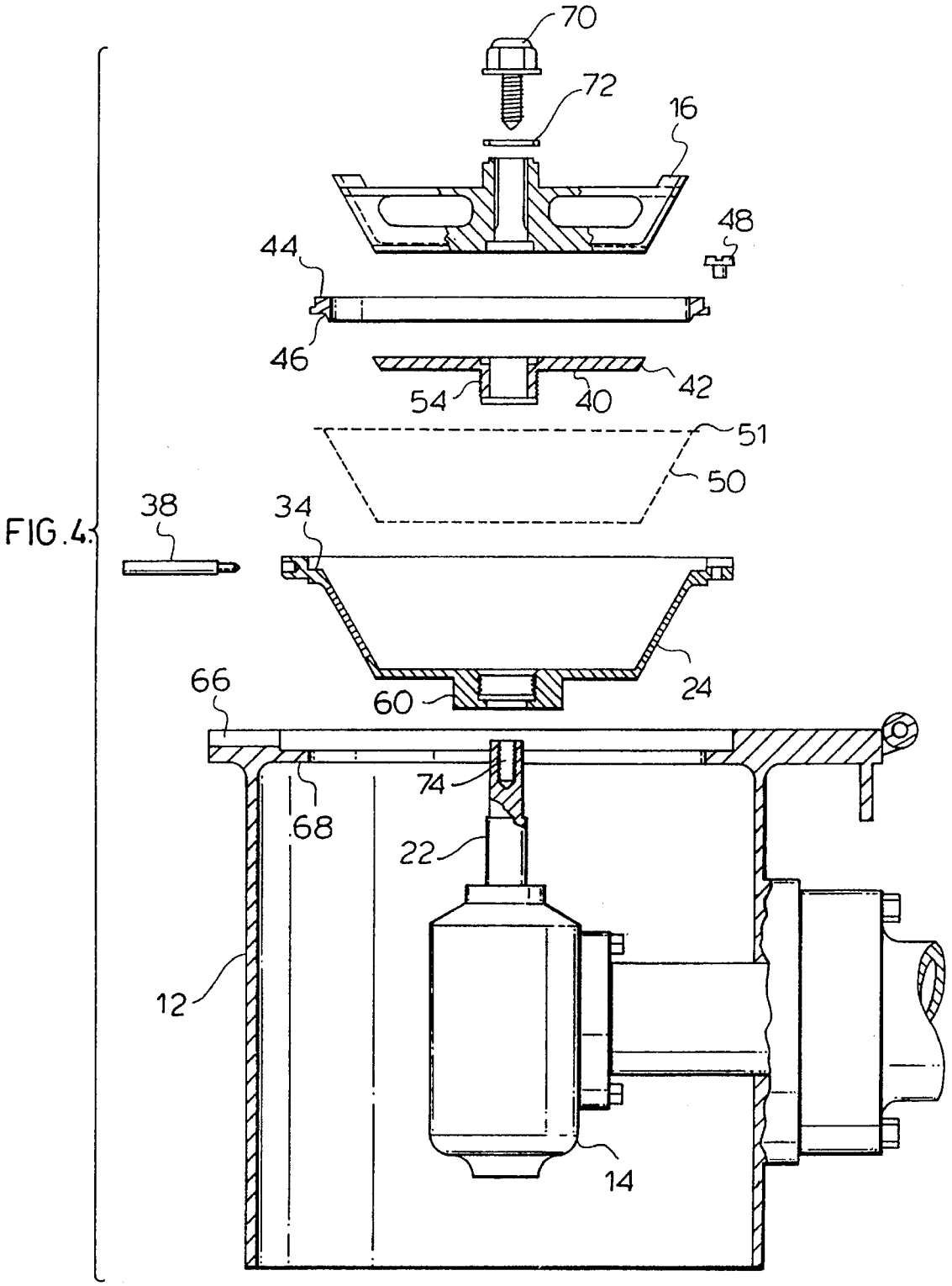
FIG. 4 is an exploded sectional view of the size reduction machine of FIG. 1.

Referring to FIG. 3, the screen module 10 of the present invention is assembled by inserting the fine screen 50 to nest within the rigid screen 24 until the narrow open end sits about the periphery of the flat end 30 of the rigid screen 24. Adaptor disc 40 engages the rigid screen 24 by threading tubular section 52 into counterbore 58. The adaptor disc 40 is tightened firmly clamping fine screen 50 into the rigid screen 24. Clamp ring 44 is then applied to the wide open end 28. Holding screws 48 are then applied to retain clamp ring 44 thereon clamping the wide end of fine screen 50 to the rigid screen 24.

The screen module 10 of the present invention is now assembled. The module 10 may be handled with minimum risk of damage to the fine screen 50. The screen module may be cleaned as a unit to be sanitize. Since the fine screen 50 is not removed for cleaning purposes, there is less possibility that the operator will damage the fine screen 50.

Once assembled, the screen module is installed by sliding the screen module 10 over the spindle 22 of the gear box 14. Flange 32 will rest on a lip 68 of shroud 12. Lifting rods 38 are inserted through bores 66 into threaded bores 36 securing screen module 10 on the shroud 12. The impeller 16 is then installed onto spindle 22 and spaced a predetermined distance from the screen defining a gap. Procedures and apparatus for setting the gap are well known and more particularly described in U.S. Pat. No. 5,282,579, the contents of which are hereby incorporated by reference. Bolt 70 with washer 72 threadingly engage threaded bore 74 of spindle 22 to retain impeller 16 thereon.

Cosmetics production requires a relatively high angular speed of impeller relative to the fine screen. Accordingly, a wide shallow frusto-conical shape for rigid screen 24 is preferred.

In use, the screen module 10 may be installed and removed repeatedly without the operator manipulating the fine screen 50. The screen module 10 may be washed and sanitized as a unit minimizing the handling and risk of damage to the fine screen 50.

As the impeller 16 rotates, centrifugal forces will urge particulate material to be directed outwardly to and through the fine screen 50. The particulate material will then pass through the apertures of apertured wall 26. The size of apertures of apertured wall 26 is greater than the mesh size of fine screen 50 and therefore rigid screen does not affect the processing of the particulate.

Figure 5:
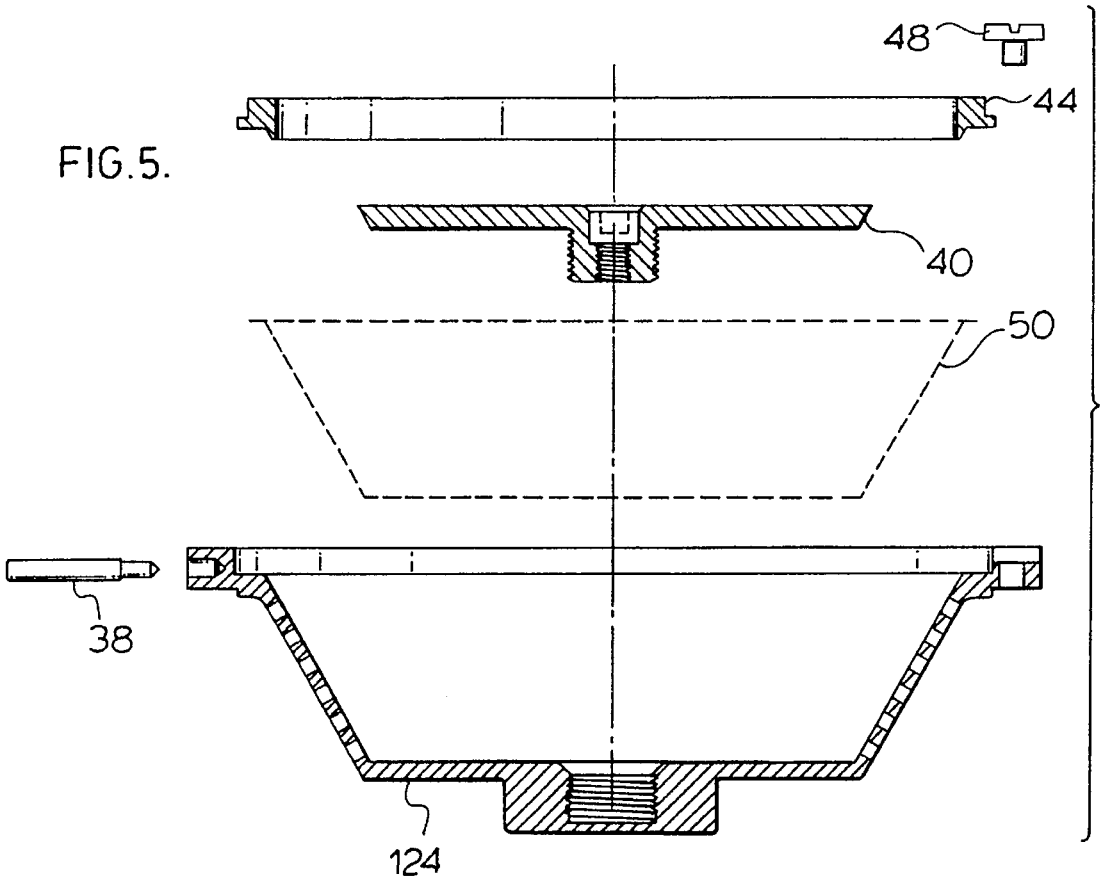
FIG. 5 is an exploded view of a second embodiment of a screen module of the present invention.
Figure 6:
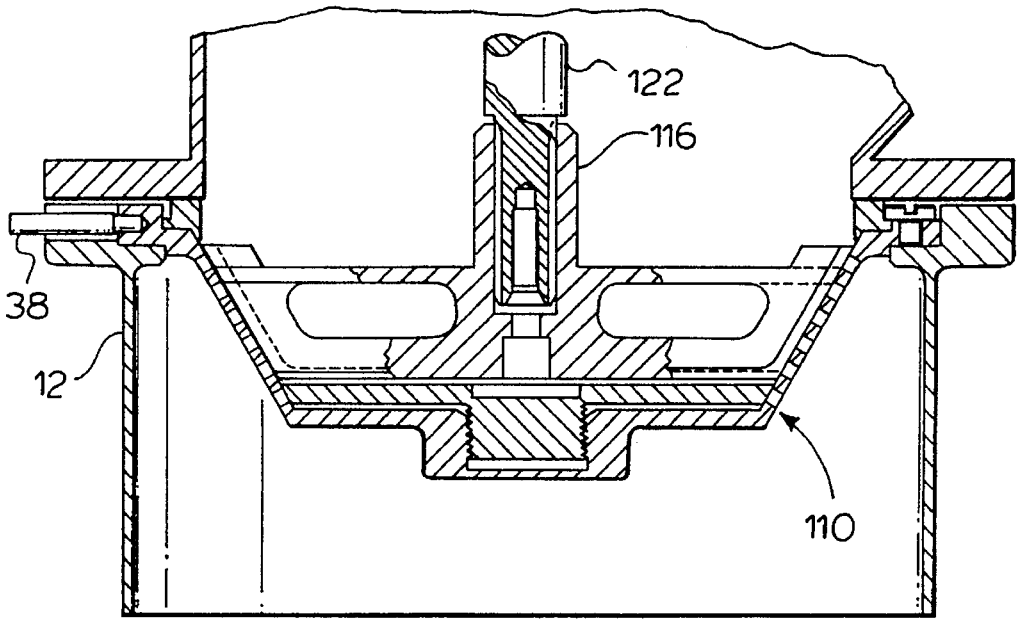
FIG. 6 is a side sectional view of a size reduction machine incorporating the screen module of FIG. 5.

Referring to FIGS. 5 and 6, a second embodiment of the screen module of the present invention is illustrated. The screen module 110 is identical to screen module 10 except that rigid screen 124 is closed and does not include opening 64. Screen module 110 is intended to be used with a top driven size reduction machine as described in U.S. Pat. Nos. 4,759,507, 4,768,722 and 4,773,599, the contents of which are hereby incorporated by reference. In this case, the impeller 116 is connected to a downwardly extending spindle 122.

While the invention herein has been described in connection with exemplary embodiments, it will be understood that many modifications will be apparent to those skilled in the art.

We claim:

1. A screen module for use in a size reduction machine, said module comprising a rigid screen having a tapered apertured wall formed in a frusto-conical shape, said rigid screen having an open wide end and a flat end, said wide end mountable within a channel of said size reduction machine at a predetermined distance from a complementarily shaped impeller, a fine screen nested within said rigid screen and against said tapered apertured wall, said fine screen having a wide end and a narrow end, an adaptor disc releasably secured within said rigid screen at said flat end, said adaptor having a tapered outer perimeter for seating against said tapered apertured wall when said adaptor disc is secured within said rigid screen, clamping said narrow end of said fine screen therebetween, and a clamp ring releasably secured at said open wide end of said rigid screen, said clamp ring having a tapered inner perimeter for seating against said tapered apertured wall when said clamp ring is secured against said open wide end, clamping said wide end of said fine screen therebetween.

2. A screen module as claimed in claim 1 wherein said rigid screen has a threaded bore for threadably engaging a threaded post on said adaptor disc.

3. A screen module as claimed in claim 1 wherein said rigid screen has a boss through which said threaded bore extends.

4. A screen module as claimed in claim 2 wherein said adaptor disc has a surface for presenting to said impeller, said surface having a coating of a polytetrafluoroethylene resin.

5. A screen module as claimed in claim 1 wherein said screen module has an axial bore for receiving a driven spindle on which said impeller is mounted defining a gap between the fine screen and the impeller.

6. A screen module as claimed in claim 5 wherein said axial bores extends through said rigid screen and said adaptor disc.

* * * * *